United States Patent [19]

Schmidt

[11] Patent Number: 4,728,009

[45] Date of Patent: Mar. 1, 1988

[54] SPRAY PUMP WITH CONTAINER CONNECTOR

[76] Inventor: Karl-Heinz Schmidt, Im Wiehagen 5, 5870 Hemer, Fed. Rep. of Germany

[21] Appl. No.: 768,117

[22] PCT Filed: Nov. 30, 1984

[86] PCT No.: PCT/DE84/00257

§ 371 Date: Aug. 13, 1985

§ 102(e) Date: Aug. 13, 1985

[87] PCT Pub. No.: WO85/02563

PCT Pub. Date: Jun. 20, 1985

[30] Foreign Application Priority Data

Dec. 14, 1983 [DE] Fed. Rep. of Germany ... 8335862[U]
Oct. 23, 1984 [DE] Fed. Rep. of Germany ... 8431062[U]

[51] Int. Cl.[4] ..... B05B 11/02; B05B 1/00

[52] U.S. Cl. ..... 222/321; 222/341; 222/382; 222/383; 222/385; 239/333

[58] Field of Search ..... 222/321, 380, 383, 385, 222/340, 341, 382, 401, 464; 239/333, 331, 329

[56] References Cited

U.S. PATENT DOCUMENTS

| | | | |
|---|---|---|---|
| 3,248,021 | 4/1966 | Corsette et al. | 222/321 |
| 3,414,169 | 12/1968 | Corsette | 222/321 |
| 3,739,955 | 6/1973 | Gores | 222/385 |
| 4,051,983 | 10/1977 | Anderson | 222/321 |
| 4,140,249 | 2/1979 | Majima | 222/385 X |
| 4,173,297 | 11/1979 | Petterson | 222/385 |
| 4,183,449 | 1/1980 | Blake | 222/321 |
| 4,189,064 | 2/1980 | O'Neill et al. | 222/385 |
| 4,225,060 | 9/1980 | Kutik et al. | 222/380 |
| 4,231,493 | 11/1980 | Kutik et al. | 222/340 X |
| 4,305,530 | 12/1981 | Nozawa | 222/385 X |
| 4,317,531 | 3/1982 | Saito et al. | 222/383 X |
| 4,496,082 | 1/1985 | Corsette | 222/321 |
| 4,527,741 | 7/1985 | Garneau | 239/333 |

FOREIGN PATENT DOCUMENTS 2049804 12/1980 United Kingdom .

*Primary Examiner*—F. J. Bartuska
*Assistant Examiner*—Edward S. Ammeen
*Attorney, Agent, or Firm*—Karl F. Ross; Herbert Dubno

[57] ABSTRACT

A spray pump having a connecting portion connectable to a container and whose housing is provided with co-axially step bores defining a venting chamber for venting the container and a pump chamber. The pump piston has oppositely conically divergent lips engaging the walls of the respective chambers and is hollow to receive the restoring spring which can also bear upon a checkvalve ball.

3 Claims, 2 Drawing Figures

SPRAY PUMP WITH CONTAINER CONNECTOR

CROSS REFERENCE TO RELATED APPLICATIONS

This application is a national phase application corresponding to the PCT/DE84/00257, filed Nov. 30, 1984 and based, in turn, upon German applications Nos. G83 35 862.5 of Dec. 14, 1983 and G84 31 062.6 of Oct. 23, 1984 under the International Convention.

FIELD OF THE INVENTION

The present invention relates to a spray pump with container connector wherein through the actuation of a pump piston slidable in a case bore a vent in contact with the atmosphere is opened, or closed, with respect to the container.

BACKGROUND OF THE INVENTION

Such spray pumps are used to draw liquids from containers and for the spraying, or atomizing of a predosed quantity of liquid. These spray pumps having casings connectable to the container are actuated mechanically from the outside by means of levers or the like, acting upon the different pumping devices. Due to the negative pressure resulting each time, a certain amount of liquid is aspired from the container through an aspiration tube, whereby in the container atmospheric pressure is maintained. The aspired liquid is directed towards a spray nozzle via a liquid supply duct, due to further pressure on the pump piston; in front of the spray nozzle a swirl chamber, for instance, can be mounted. During each compression stroke, the container is ventilated, so that the atmospheric pressure in the container is reestablished.

Spray pumps of various kinds are known which, for instance, can be threaded to the container via a connector piece or via an intermediate piece and a connection nut. It is known to act upon the elastical sealing collar of the intermediate piece through the lever actuating the pump and the corresponding rods so that this collar is pressed away from the surface to be sealed at each actuation, leaving a passage for the ventilation of the container. It is also known to unblock a vent leading to the container connector via the pump piston sliding in a corresponding bore of the casing. In both cases it is necessary to control the ventilation in order to avoid unintended discharge of the liquid through the vent in the corresponding, or reversed position of the container with the spray pump threaded thereto. For this reason the vent has to be sealed towards the outside. The known actuation means for ventilation require additional parts, or bore channels.

OBJECT OF THE INVENTION

It is the object of the present invention to simplify the construction of the necessary ventilation system via the container connector in a spray pump as described above.

SUMMARY OF THE INVENTION

The object of the invention is attained with a spray pump having a crown-shaped lip seal on the pump piston or its rod, which prior to the actuation of the piston is pressed sealingly against a smooth segment of the casing bore and after the displacement of the piston in pumping direction, allows for the opening of a complete or partial annular slot between the lip seal and the inner wall of the bore.

Thereby, a casing bore widening towards the side of the container connector and an open connection from the casing bore to the container connector can be provided. Preferably, this casing bore is conically widened in stages, whereby the opening angles of the conical segments differ from each other.

In such a casing bore constructed according to the invention the lip seal provided on the pump piston merely slides along smooth wall surfaces. Due to its inherent tension, in the closed position the lip seal presses sealingly against the wall of the respective segment of the casing bore. When the pump piston is displaced, the respective lip seal reaches an area, where due to the conical configuration of the casing bore, an open annular slot between the seal and the wall of the bore is created. Thereby, an open connection between both frontal sides of the bore is created. This bore is open from the side where the pressure is applied towards the atmospehre An escape towards the container is provided in the direction of the connector.

A further embodiment of a spray pump according to the invention is characterized by the fact that in the case bore bars running parallelly to each other in longitudinal direction and spaced apart from each other are provided, the lip seal being slidable thereon, whereby a ventilation connection from the atmosphere to the container connector is opened. In a further development of such a spray pump it is proposed to provide at the end of the case bore opening towards the atmosphere an inner arresting collar against which the lip seal comes to stop when the piston is automatically reset by spring pressure. This way, a traction-proof support system of the pump piston in its case bore is achieved. The tapered crown-shaped lip seal hits the inner arresting collar of the case bore when the piston is pushed back under pressure, preventing the piston from being pulled out of the bore.

SPECIFIC DESCRIPTION

Figure 1:
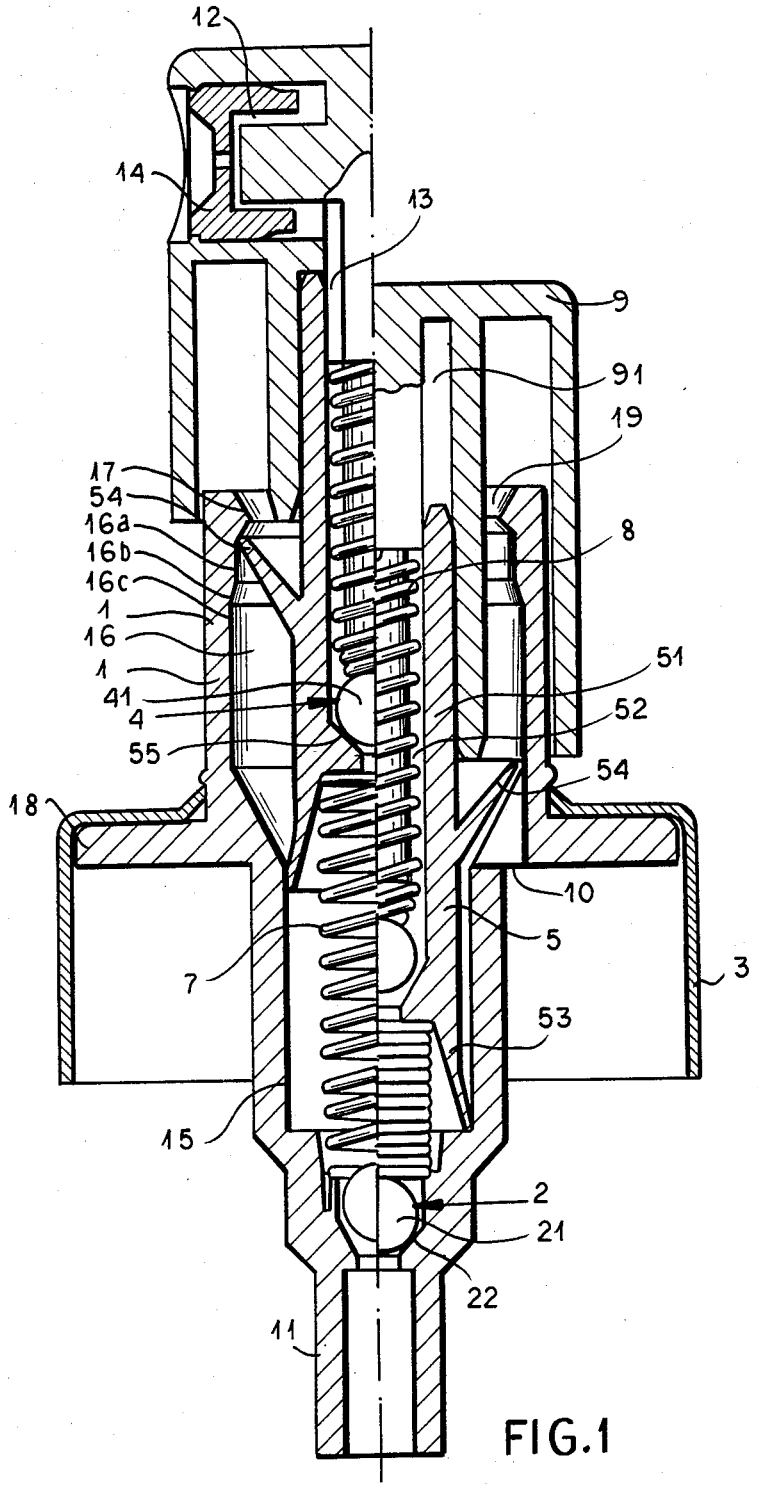
FIG. 1 is a longitudinal section through a spray pump with the pump piston in closed and actuated positions.
Figure 2:
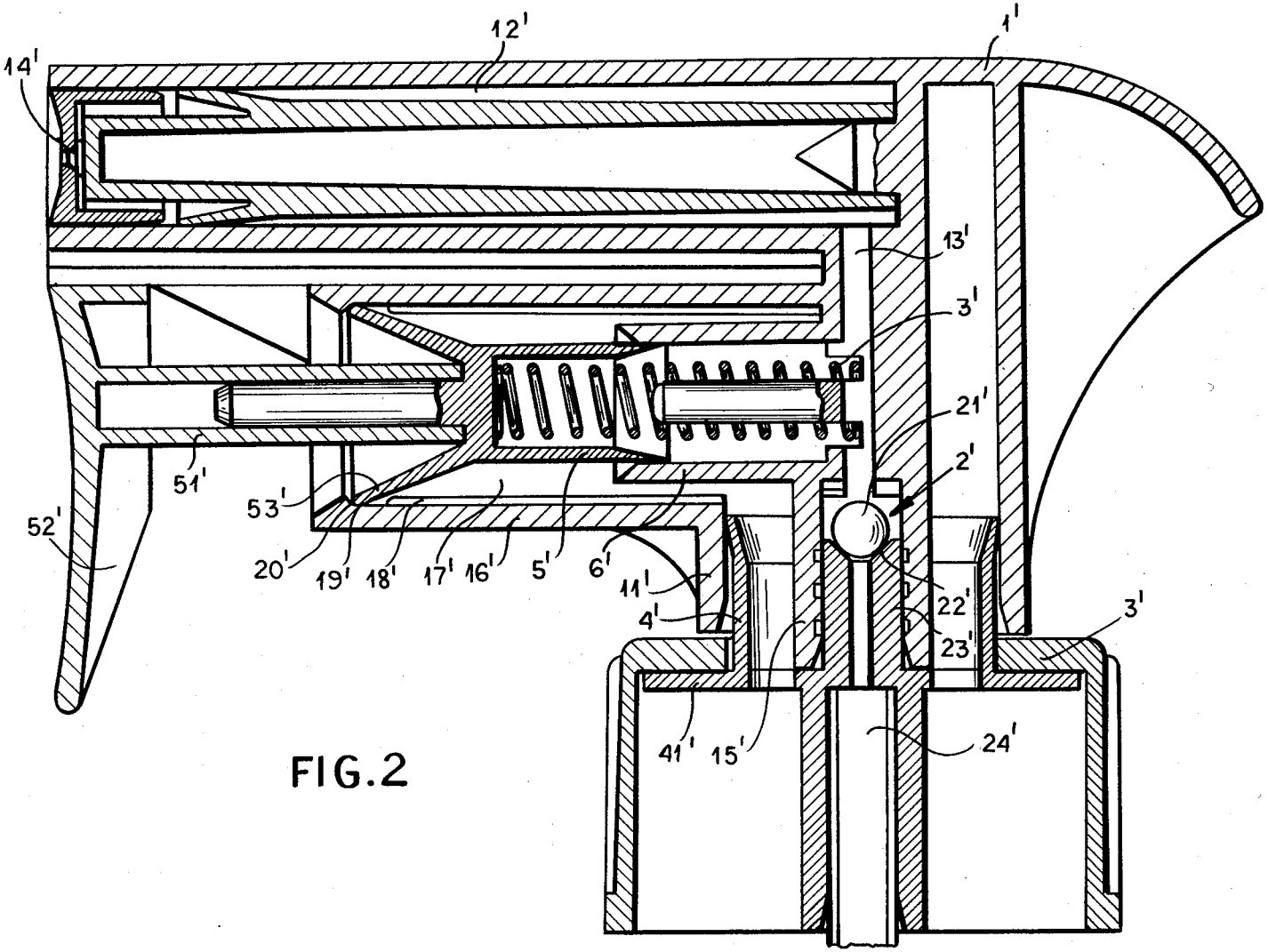
FIG. 2 is a longitudinal section through another embodiment of a spray pump with the pump piston in its closed position.

First reference will be made to FIGS. 1

The totality of the synthetic-material case of housing of the shown swirl-nozzle spray pump is marked with 1. With a flange 18 externally molded thereto this housing can be connected to a container not shown in the drawing by means of a cap-like container connector 3. The bottom socket 11 of the casing 1 provided with a passage for the liquid to be sprayed extends into the container.

Behind a supply duct a first check valve 2 is provided, consisting of a ball 21, the valve 22 and the spring 7 acting against the ball; this spring rests against the pump piston 5 in which it is partially received.

The pump piston 5 extends with a crown-shaped lip seal 53 into the actual pump cylinder 15, which is connected to one side with the socket 11 via the valve 2. This pump piston 5 is hollow. At its end directed towards the pump cylinder 15 a second check valve 4 is provided on the inside, which again consists of a ball 41 and a valve seat 55, as well as of the pressure spring 8. On the piston rod 51 protruding from the housing 1 through its frontal opening 19 the trigger 9 or manual operator with the guide 91 is mounted on the outside.

The hollow piston rod 51 is connected with a channel 13 on the trigger 9; the channel leads to a swirl chamber 12 in whose opening towards the outside the spray nozzle 14 is mounted.

When via the trigger 9 the pump piston is pressed downward in the direction of the container connector, liquid is pressed from the narrowing pump cylinder small-diameter bore 15 over the opened check valve 4 through the hollow piston 5 to the duct 13 and from there to the swirl chamber 12 and through the spray nozzle 14 to the outside.

In order to balance the vacuum created in the container for the next aspiration process, ventilation takes place in this position through the housing bore 16 in contact with the atmosphere and through the escape 10 in the area of the flange 18.

The trigger 9 is lifted upon release due to the pressure spring 7. The pump piston 5 slides back. A crown-shaped lip seal 54 on the outside of the piston rod 51 slides thereby from the position according shown at the left hand side of FIG. 1 to the right-hand position in FIG. 1. It can be seen that this case bore (large-diameter chamber) 16 widens conically in stages towards the connector side. In the closed position, the lip seal 54 is pressed sealingly against the segment **16*a* of the case bore. The case bore 16 is thereby closed with respect to the the frontal opening 19. During the displacement of the piston in the direction of the container connector, the lip seal reaches the next conically widened segment 16*b* of the case bore 16 and after that the area of the cylinder segment 16*c*, where between the lip seal 54 and the bore wall an annular slot is created to make possible the ventilation. The conical casing bore segment 16*a* defining the closed position has a smaller opening angle of the cone than the following case segment 16*b***.

The totality of the synthetic-material casing of the swirl-nozzle spray pump shown in FIG. 3 is marked with the numeral 1'. In its bottom area there is a socket 11', in which the connecting piece 4' is inserted. On the flange 41' of this connecting piece 4' protruding outwardly a connection cap 3' is mounted, through which the casing can be threaded to a container not shown here.Through the pipe-shaped connecting piece 4' protrudes a duct socket 15' molded to the housing, the aspiration tube 24' extending downwardly being a continuation thereof.

This aspiration duct is thereby held in a socket 23' which is again fastened to the duct socket 15'. The upper end of this socket 23' forms the valve seat 22', which together with a sphere 21' creates the check valve 2'. Above this check valve 2' the recess 16' which receives the pump piston is provided, this recess running in transversal direction with respect to the connection channel 13'.

In this recess 16' the open pump cylinder 6' is molded concentrically with respect to the channel 13', the pump piston 5' being displaceable from the outside in this cylinder. The pump piston 5' is pressed each time automatically in its extreme position via the pressure spring 7' resting against the inside of the casing. The pump piston 5' is prolonged towards the exterior with the rod 51' on which a lever 52' is provided, guided parallel to the axis of the piston.

The pump recess 16', or the bore 17' provided therein is open towards the lever 52', e.g. in contact with the atmosphere. With its other end it is in open contact with the container connector piece 4'. In order to seal this ventilation opening while the pump is not in operation, a crown-shaped lip seal 53' is provided, which due to its inherent pressure presses sealingly against a smooth sealing segment 19' of the bore 17'. This crown-shaped lip seal creates at the same time an arresting means for the movements of the piston, since in its extreme position it stops against an inner arresting collar 20' in the pump recess 16'.

When the piston 5' is actuated via the lever 52' in the direction of the pressure, the lip seal 53' slides on the longitudinal bars 18' in the bore 17'. These longitudinal bars parallel to each other are spaced apart, so that between the bars a connection passage with the shape of a partial annular slot to the connecting piece 4' is opened, whereby the ventilating of the container takes place.

During the spring-loaded reverse motion of the piston 5' a negative pressure is created in the cylinder 6'. In the aspiration duct 24' the liquid rises under the effect of the external atmospheric pressure through the check valve 2' and partially fills the pump cylinder 6', as well as the channel 13'. After leaving the bars 18', the lip seal 53' again seals the bore 17' in the area of the sealing segment 19', so that even when the container is in an inclined or reversed position, the liquid can not escape.

During the next actuation of the piston 5' in the direction of the pressure, the liquid aspired into the cylinder 6' and the channel 13' is pushed towards the evacuation- or supply duct 12' and from there is sprayed through the nozzle 14' and the swirl chamber mounted before it. The check valve 2' is closed at this time.

I claim:

1. A spray pump, comprising:

a housing formed with a connector connectable with a container and provided with a passage opening through said connector;

a checkvalve in said housing along said passage blocking return flow through said passage to said container but permitting flow through said passage to an outlet of the spray pump, said housing being formed with a small-diameter cylindrical chamber communicating with said passage between said valve and said outlet, and with a large-diameter cylindrical chamber axially aligned with said small-diameter cylindrical chamber and connected with said small-diameter cylindrical chamber, said large-diameter cylindrical chamber communicating with said container outside said passage;

a pump piston displaceable along a common axis of said chambers, said pump piston being hollow at least at one end thereof turned toward said passage and formed with a cavity opening at said end toward said passage and closed by a transverse wall, said end of said pump piston being formed with a frustoconically outwardly diverging lip of outward progressively diminishing wall thickness sealingly engaging an inner wall of said small-diameter chamber, said pump piston having another lip frustoconically outwardly divergent and of progressively diminishing wall thickness toward the opposite end of the piston and engaging an inner wall of said large-diameter chamber and venting said container during a stroke of said piston;

a coil spring at least partly received in said cavity and seated directly against said transverse wall and biasing said pump piston away from said passage; and a manual operator connected to said opposite end of said pump piston for actuating same.

2. A spray pump, comprising:

a housing formed with a connector connectable with a container and provided with a passage opening through said connector;

a checkvalve in said housing along said passage blocking return flow through said passage to said container by permitting flow through said passage to an outlet of the spray pump, said housing being formed with a small-diameter cylindrical chamber communicating with said passage between said valve and said outlet, and with a large-diameter cylindrical chamber axially aligned with said small-diameter cylindrical chamber and connected with said small-diameter cylindrical chamber, said large-diameter cylindrical chamber communicating with said container outside said passage;

a hollow pump piston displaceable along a common axis of said chambers and having an internal annular shoulder forming a seat for another checkvalve, one end of said pump piston turned toward said passage being formed with a frustoconically outwardly diverging lip of outward progressively diminishing wall thickness sealingly engaging an inner wall of said small-diameter chamber, said pump piston having another lip frustoconically outwardly divergent and of progressively diminishing wall thickness toward the opposite end of the piston and engaging an inner wall of said large-diameter chamber and venting said container during a stroke of said piston; a coil spring at least partly received in said piston, seated directly against said shoulder, bearing upon the first-mentioned checkvalve, and biasing said pump piston away from said passage; and a manual operator connected to said opposite end of said pump piston for actuating same, said pump piston being formed at said opposite end unitarily with a stem surrounded coaxially and spacedly by said lip of said opposite end, said manual operator being fitted onto said stem, said operator having a sleeve receiving said stem.

3. A spray pump, comprising:

a housing formed with a connector connectable with a container and provided with a passage opening through said connector;

a checkvalve in said housing along said passage blocking return flow through said passage of said container but permitting flow through said passage to an outlet of the spray pump, said housing being formed with a small-diameter cylindrical chamber communicating with said passage between said valve and said outlet, and with a large-diameter cylindrical chamber axially aligned with said small-diameter cylindrical chamber and connected with said small-diameter cylindrical chamber, said large-diameter cylindrical chamber communicating with said container outside said passage;

a pump piston displaceable along a common axis of said chambers, said pump piston being hollow at least at an end thereof turned toward asid passage and formed with a cavity opening at said end toward said passage and closed by a transverse wall, said end of said pump piston being formed with a frustoconically outwardly diverging lip of outward progressively diminishing wall thickness sealingly engaging an inner wall of said small-diameter chamber, said pump piston having another lip frustoconically outwardly divergent and of progressively diminishing wall thickness toward the opposite end of the piston and engaging an inner wall of said large-diameter chamber for venting said container during stroke of said piston, said opposite end being further formed unitarily with an axially extending step coaxially surrounded by and annularly spaced from said other lip;

a coil spring at least partly received in said cavity, seated directly against said transverse wall and biasing said pump piston away from said passage; and a manual operator connected to said opposite end of said pump piston for actuating same, said manual operator having a sleeve fitted onto said stem.

* * * * *